US008691028B2

(12) United States Patent
Kendig et al.

(10) Patent No.: US 8,691,028 B2
(45) Date of Patent: Apr. 8, 2014

(54) ARTICLE HAVING A HEXAVALENT-CHROMIUM-FREE, CORROSION-INHIBITING ORGANIC CONVERSION COATING THEREON, AND ITS PREPARATION

(75) Inventors: Martin W. Kendig, Thousand Oaks, CA (US); Melitta M. Hon, Daly City, CA (US); Leslie F. Warren, Jr., Camarillo, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/382,499

(22) Filed: May 10, 2006

(65) Prior Publication Data

US 2007/0261765 A1 Nov. 15, 2007

(51) Int. Cl.

| | |
|---|---|
| ***C23C 22/48*** | (2006.01) |
| ***C23C 22/56*** | (2006.01) |
| *C23C 22/02* | (2006.01) |

(52) U.S. Cl.

USPC ..... 148/243; 148/251; 148/275; 148/276; 148/277; 106/14.05

(58) Field of Classification Search

USPC ..... 148/243, 251, 275–277; 106/14.05

See application file for complete search history.

(56) References Cited

U.S. PATENT DOCUMENTS

| | | | | |
|---|---|---|---|---|
| 5,645,890 | A | | 7/1997 | MacDiarmid et al. |
| 5,824,371 | A | * | 10/1998 | Epstein et al. ..... 427/388.1 |
| 5,922,466 | A | * | 7/1999 | Angelopoulos et al. ..... 428/418 |
| 5,928,795 | A | * | 7/1999 | Spellane et al. ..... 428/457 |
| 6,139,610 | A | | 10/2000 | Sinko |
| 6,248,181 | B1 | | 6/2001 | Osako et al. |
| 6,309,477 | B1 | | 10/2001 | Shimakura et al. |
| 6,562,474 | B1 | | 5/2003 | Yoshimi et al. |
| 6,579,472 | B2 | | 6/2003 | Chung et al. |
| 6,716,370 | B2 | | 4/2004 | Kendig |
| 6,818,118 | B2 | | 11/2004 | Kinlen et al. |
| 6,866,797 | B1 | | 3/2005 | Martin et al. |
| 6,942,899 | B2 | | 9/2005 | Kendig et al. |

FOREIGN PATENT DOCUMENTS

| | | | | |
|---|---|---|---|---|
| EP | 1382721 A1 | | 1/2004 | |
| WO | WO 99/24991 | * | 5/1999 | ..... H01B 1/12 |

OTHER PUBLICATIONS

Kendig et al., "Environmentally Triggered Release of Oxygen-Reduction Inhibitors from Inherently Conducting Polymers," Corrosion, pp. 1024-1030, Nov. 2004.*

B. Wessling, Corrosion Prevention with an Organic Metal (Polyaniline): Surface Ennobling, Passivation, Corrosion Test Results, 1996, pp. 439-445.*

PCT International Search Report; Nov. 12, 2007; 10 pgs.

* cited by examiner

*Primary Examiner* — Lois Zheng

(74) *Attorney, Agent, or Firm* — Klintworth & Rozenblat IP LLC

(57) ABSTRACT

A method for protecting a surface of an article includes preparing or otherwise providing a reactive solution of a form of polyaniline and an acid, thereafter applying the reactive solution to the surface of the article to form an adherent conversion coating on the surface, thereafter oxidizing the adherent conversion coating to form an oxidized coating, and thereafter contacting a chromate-free, corrosion inhibiting organic compound such as a salt of a dithiocarbamate or a salt of a dimercaptothiadiazole to the oxidized coating to form a fixed conversion coating on the surface of the article. The resulting article has the fixed conversion coating adhered to the surface of the article. The fixed conversion coating has a mixture of a reduced polyaniline salt, and a fixed disulfur-linked dithiocarbamate polymer or dimer.

15 Claims, 5 Drawing Sheets

ARTICLE HAVING A HEXAVALENT-CHROMIUM-FREE, CORROSION-INHIBITING ORGANIC CONVERSION COATING THEREON, AND ITS PREPARATION

This invention relates to the protection of an article against corrosion and, more particularly, to such protection achieved with a hexavalent-chromium-free, corrosion-inhibiting organic conversion coating applied to the surface of the article.

BACKGROUND OF THE INVENTION

Metals may be attacked by corrodants that are present in the environments in which the metals operate. For example, aluminum articles contacted to a salt-containing environment may be attacked at their surfaces either generally over a large area or locally in limited areas, for example at weld joints, at bolt holes, or at small inclusions or pits in the surface. The corrosion damage increases over time and with continued exposure, eventually possibly leading to such severe corrosion that there is a premature initiation of failure of the article at an earlier time than would otherwise be the case in the absence of the corrosion damage. Large amounts of money are spent on corrosion protection, yet corrosion damage and corrosion-induced premature failure are still widespread.

Coatings are widely employed to protect surfaces against corrosion damage. Some of the most effective coatings employ hexavalent chromium having chromium ions in the +6 oxidation state ($Cr^{+6}$), usually in the form of chromate ions $CrO_4^{-2}$, as part of the coatings to impart corrosion resistance to the surfaces. Chromate conversion coatings chemically bond strongly to the surfaces of the articles when exposed at room temperature, and thereafter inhibit corrosion at the surfaces.

There is a desire to reduce the amount of chromate used in coatings and other applications, largely because hexavalent chromium ions can have adverse environmental effects and adverse health effects. Future regulations are expected to impose large reductions in the amount of hexavalent chromate that may be used in most applications, including coatings for reducing the corrosion of articles.

At the present time, there are no effective substitutes for the chromate-containing coatings. Some non-chromate coatings are available to improve the adhesion of paint primers and paints to surfaces, but the non-chromate coatings themselves have little or no corrosion-resistance properties. If corrosion inhibitors are added to the non-chromate coatings to impart corrosion resistance, an elevated-temperature curing is typically required. The use of the elevated-temperature curing is impractical and uneconomical for many applications. Other non-chromate coatings serve only as barriers between a corrosive medium and the surface of the underlying metal, without serving as active corrosion inhibitors. If the barrier of these coatings is breached, as for example by a hole or scratch extending through the barrier coating, there is no chemical inhibition of the resulting potential corrosion.

There is a need for an improved coating approach to protecting articles against corrosive attack, while using little or no hexavalent chromium. The present invention fulfills this need, and further provides related advantages.

SUMMARY OF THE INVENTION

The present approach provides a metal article protected by a conversion coating that is free of hexavalent chromium and chromate ions, and a method for applying and protecting such an article using the hexavalent-chromium-free conversion coating. This technique avoids the use of chromate ions in the coating, while achieving excellent protection of the article against corrosion. The present conversion coating also provides an adherent base to which primers and paints may be applied and thereby adhered to the surface of the metal article.

In accordance with the invention, a method for protecting a surface of a metallic article comprises the steps of providing a reactive solution of an oxidized form of an electrically conducting polymer (preferably a polyaniline) and an acid, thereafter applying the reactive solution to the surface of the article to form an adherent conversion coating on the surface, thereafter oxidizing the adherent conversion coating to form an oxidized coating, and thereafter contacting a non-chromate, reversibly oxidizable inhibitor (preferably a salt of a dithiocarbamate or a salt of a dimercaptothiadiazole) to the oxidized coating to cause a fixing reaction that forms a fixed conversion coating on the surface of the article. The fixed conversion coating, when damaged, releases the inhibitor by a reversal of the fixing reaction.

In the preferred approach, the polyaniline is preferably emeraldine base. The reactive polyaniline solution preferably comprises an organic acid such as formic acid, and most preferably is a mixture of formic acid and di-chloroacetic acid. The reactive solution may be applied by any operable technique, such as spray, brush or spin application. The oxidation is preferably accomplished by exposing the adherent conversion coating to air at room temperature. The salt of the dithiocarbamate or the salt of the dimercaptothiadiazole is of any operable type, and examples include the ammonium salt of 1-pyrrolidinedithiocarbamate, the dipotassium salt of 2,5 dimercapto 1,3,4 thiadiazole, the sodium salt of diethyldithiocarbamate, and the sodium salt of dimethyldithiocarbamate. The selection of the hexavalent-chromium-free, corrosion-inhibiting organic compound may depend upon the specific type of corrosive agent for which protection is required.

In a typical application, the article with the fixed conversion coating thereon is exposed to a corrosive environment, such as a salt-containing environment. It is preferred that the article is not intentionally heated to a temperature of greater than about room temperature (i.e., about 25° C.) as part of the processing during or after the step of applying and before the step of exposing. That is, heating is not required for the success of the processing approach. Unintentional heating to temperatures above room temperature, for example as a result of an increase in the ambient temperature on a warm day or the article being heated by the sun, is acceptable.

Thus, in a preferred embodiment a method for protecting a surface of an article comprises the steps of providing a reactive solution of emeraldine base and an acid comprising formic acid, thereafter applying the reactive solution to a surface of the article comprising aluminum to form an adherent conversion coating on the surface, thereafter oxidizing the adherent conversion coating to form an oxidized coating by exposing the adherent conversion coating to air, and thereafter contacting a salt of a dithiocarbamate or salt of a dimercaptothiadiazole to the oxidized coating to form a fixed conversion coating on the surface of the article. Other operable processing steps discussed herein may be used in connection with this embodiment.

An article whose surface is protected comprises the article, and a fixed conversion coating adhered to a surface of the article. The fixed conversion coating comprises a mixture of a chemically reduced polyaniline salt, and a fixed hexavalent-chromium-free (i.e., chromate free), reversibly oxidizable, corrosion-inhibiting organic compound such as a disulfur-linked dithiocarbamate or a dimercaptothiadiazole polymer or dimer. Any operable materials or components discussed herein may be used in connection with this embodiment.

In the present approach, the reactive solution of the polyaniline and the acid is prepared or otherwise provided and applied to the surface of the article. This reactive solution reacts with the surface of the article to form a reduced polyaniline salt and an oxide bonded to the surface. The reduced polyaniline salt is oxidized, most readily by exposure to air, to form the oxidized coating. The salt of the dithiocarbamate or the dimercaptothiadiazole reversibly reacts with the oxidized coating to form the fixed conversion coating on the surface of the article. The fixed conversion coating includes the polymerized or dimerized insoluble dithiocarbamate or dimercaptothiadiazole mixed with the polyaniline. The dithiocarbamate or dimercaptothiadiazole is oxidatively polymerized or dimerized with a di-sulfide link.

When the surface of the metal article with the conversion coating thereon is later exposed to a corrosive environment that causes corrosion by an electrochemical reaction at a potential corrosion site such as the damage caused by a breach in the naturally occurring oxide coating on the surface of the metal article, the polymerized conversion coating electrochemically depolymerizes and releases the chromate-free (i.e., hexavalent-chromium-free), corrosion-inhibiting organic compound, such as the dithiocarbamate or the dimercaptothiadiazole oxygen-reduction reaction (ORR) inhibitor, at the surface. The dithiocarbamate or dimercaptothiadiazole ORR inhibitor renders the intermetallic phases on the metal surface inactive for the oxygen-reduction half of the corrosion reaction, thereby inhibiting the oxygen reduction half reaction and thence inhibiting the overall corrosion process.

The present approach thus achieves inhibition of electrochemical corrosion processes in a conversion coating without the presence of any hexavalent chromium and/or chromate. It is easily used, does not require exposure to special atmospheres during processing, and does not require heating to fix, polymerize, or otherwise react the components. The process is environmentally benign, and does not involve any toxic or noxious components. The present approach may be employed in an initial manufacturing operation to protect the surface of the article. The present approach may also be used for field repairs or restorations of the protective fixed conversion coating; because it does not require heating or other step that uses specialized equipment that may not be available in a field setting.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
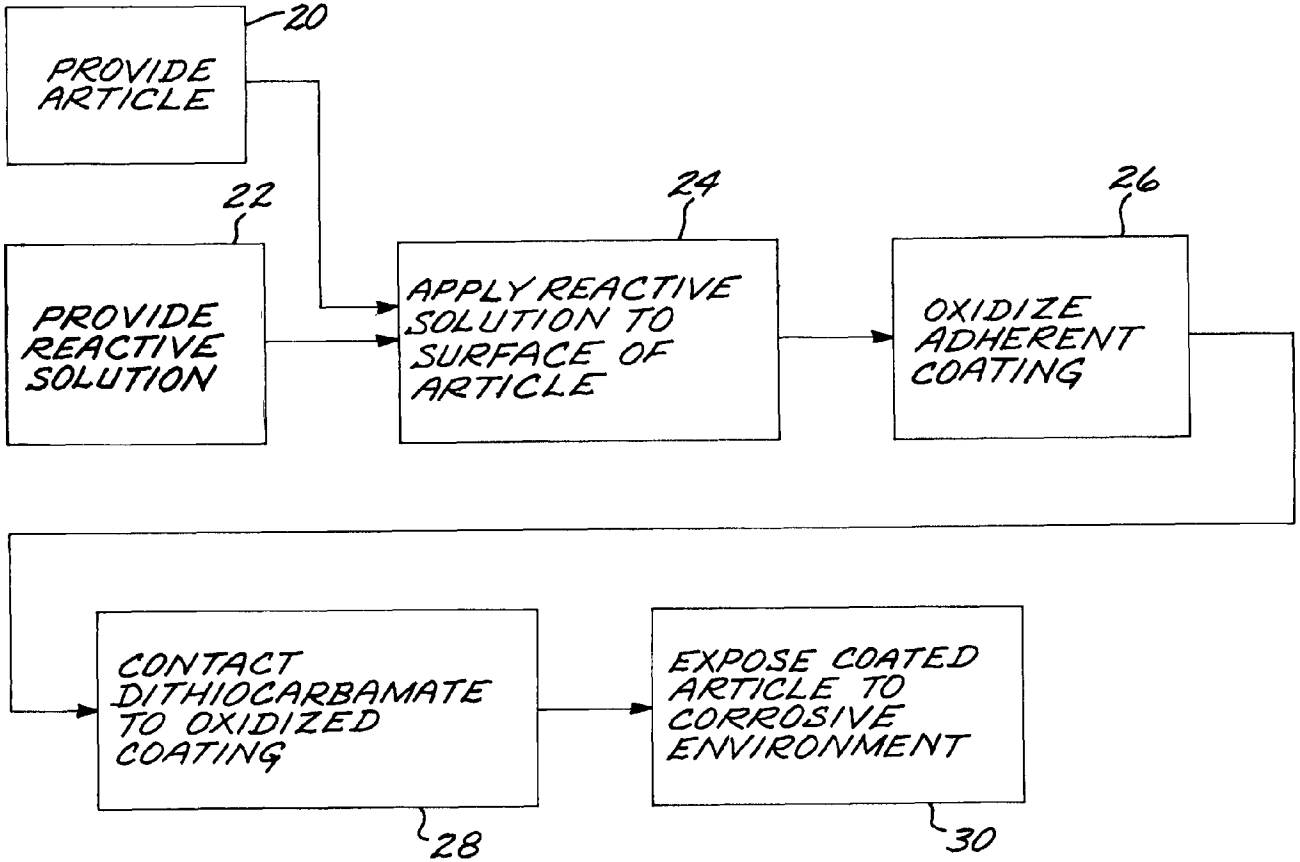
FIG. 1 is block flow diagram of a process for applying and using the surface protection of the present approach.

FIG. 1 depicts the steps in a process for protecting a surface of an article, and FIGS. 2A-2E show the structures and chemical states at various stages of the processing. (FIGS. 2A-2E and 6 are not drawn to scale.) The method includes first providing the article 40 having the surface 42, step 20 of FIG. 1 and FIG. 2A. The article 40 may be of any operable type or material. A preferred material is an aluminum article 40. As used herein, "aluminum" when used to describe the article may refer to pure aluminum, aluminum-containing alloys, and aluminum-base alloys. An aluminum-base alloy includes more aluminum than any other element.

The article may be of any physical form having the surface 42. The article 40 need not be specially prepared prior to the processing described herein, other than ensuring that the surface 42 is not dirty or covered in whole or in part by a physical barrier of organic matter as oil or grease. If there is dirt or a barrier, it is removed by physical cleaning in step 20.

A reactive solution is provided, step 22. The reactive solution includes an emeraldine form of polyaniline (PANI) or other organic-acid-soluble electrically conducting polymer in its oxidized form, and an acid. The preferred form of polyaniline is emeraldine base, which is relatively stable as compared with other forms of polyaniline, may be converted to an electrically conductive salt form, and exhibits the necessary strongly oxidized and reduced states. The acid may be of any operable type that forms a solution with the selected form of polyaniline, but preferably comprises an organic acid such as formic acid. Most preferably, the acid is a mixture of formic acid and another acid such as di-chloroacetic acid, such as in a ratio of 80 parts by volume formic acid and 20 parts by volume di-chloroacetic acid. Any operable ratio of the polyaniline and the acid may be used. In a preferred embodiment, the ratio of oxidized emeraldine base to 80:20 anhydrous formic acid:di-chloroacetic acid in a reactive solution is about 4 percent by weight. The amount of water present may be adjusted to control the viscosity of the reactive solution to be suitable for the selected application approach. The chemical reaction within the reactive solution produces an electrically conductive polyaniline salt, in this case an electrically conductive emeraldine salt.

Figures 2A, 2B, 2C, 2D, 2E:
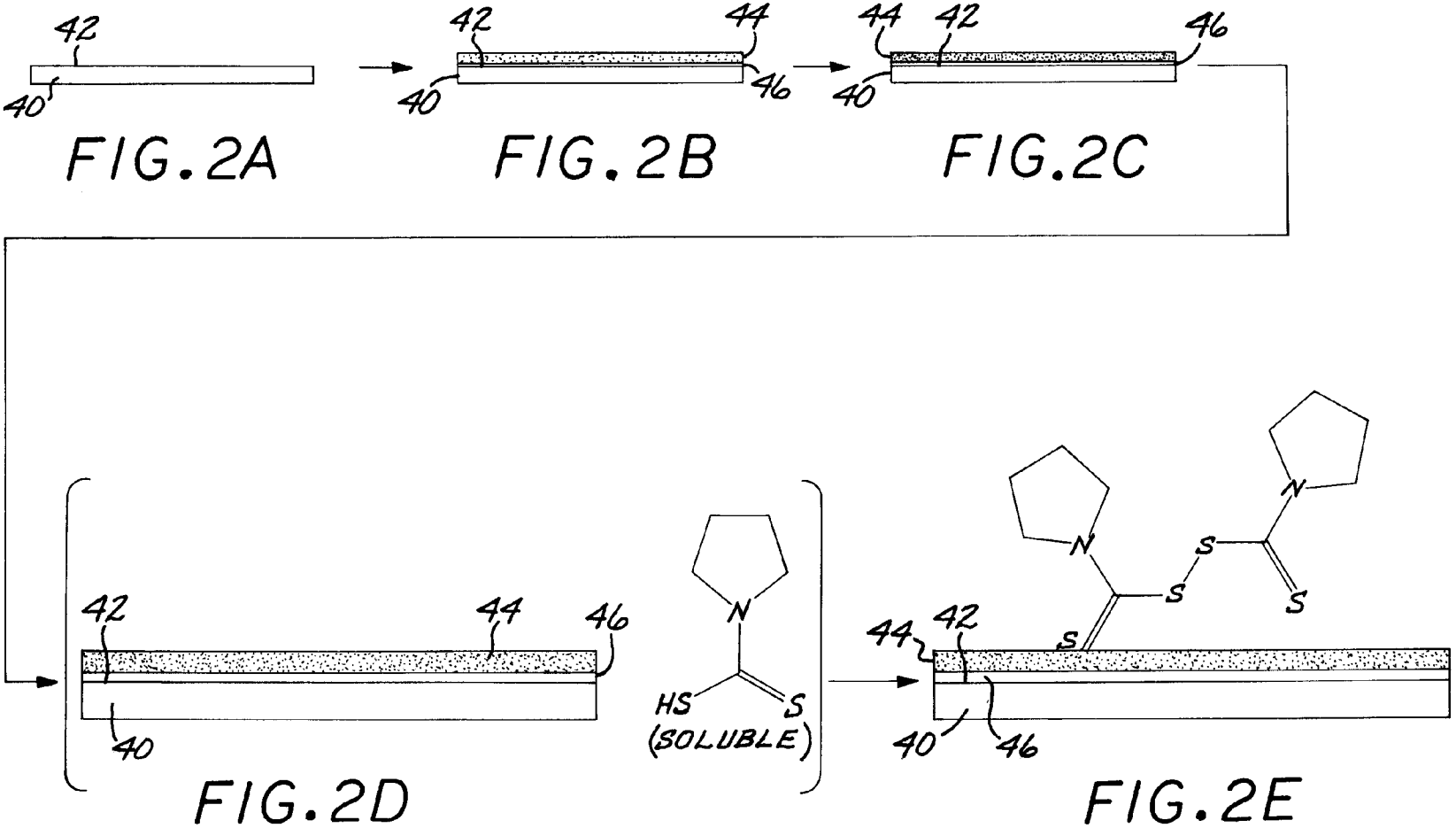
FIGS. 2A-2E are a set of schematic drawings illustrating the structures during the surface protection processing steps as shown in FIG. 1.

The reactive solution is thereafter applied to the surface 42 of the article 40 and dried at room temperature to form an adherent conversion coating 44 on the surface 42, step 24. The application step 24 may be accomplished by any operable approach, with examples being spray, brush or spin application. The thickness of the adherent conversion coating 44 depends upon the reactivity and viscosity of the reactive solution and the application technique. Typically, however, after drying the conversion layer and adherent conversion coating 44 is from about 0.25 to about 1 micrometer thick, and typically about 0.4 micrometer thick. FIG. 2B depicts the adherent conversion coating 44 on the surface 42 of the article 40. This same general physical appearance is retained throughout the processing, although the relative thickness, physical appearance of the coating, and color of the coating at different stages of the process may vary.

In the application step 24, the polyaniline salt reacts with the metal of the article 40 to reduce the salt and form a metallic oxide layer 46 at the surface 42 of the article 40. FIG. 2B is not drawn to scale, and in reality the metallic oxide layer 46 is so thin, well below 1 micrometer in thickness, as to be not readily visible in respect to its thickness. However, the metallic oxide layer 46 may be visible as a result of its color and a color change that occurs during the processing.

The polyaniline solution is initially dark-green to almost-black in color. When applied to the aluminum surface 42, the polyaniline solution first turns a light-green color and then a pale-yellow color as it reacts chemically with the surface 42 to form the thin aluminum oxide layer 46. The color change evidences the reduction of the polyaniline and oxidation of the aluminum 42 to form the oxide 46 on the surface of the metallic article 40. The layer thus formed is a conversion layer incorporating the reduced polyaniline and a thin layer of metallic aluminum is converted to aluminum oxide. As such, the coating provides strong adhesion to the surface.

The adherent conversion coating 44 is thereafter oxidized, step 26, to form an oxidized coating, also indicated by numeral 44, in preparation for the next step of the processing. FIG. 2C illustrates the oxidized adherent conversion coating 44. The oxidation 26 may be performed by any operable technique, but is preferably performed simply by exposing the adherent conversion coating 44 to air and the oxygen in the air at room temperature. The chemical effect of this oxidation 26 is that the reduced polyaniline salt produced in the application step 24 is oxidized to a polyaniline salt. Evidence for this reoxidation is that the coating becomes dark in color again upon exposure to air after coating. In the preferred embodiment, the reduced emeraldine salt of the application step 24 is oxidized to an emeraldine salt. The oxidized coating 44 of oxidized polyaniline (e.g., emeraldine) salt remains adherently bonded to the surface 42.

The oxidized coating 44 containing the polyaniline salt, preferably emeraldine salt, is thereafter contacted, step 28, with an operable hexavalent-chromium-free, corrosion-inhibiting compound, such as the preferred salt of the dithiocarbamate or the salt of the dimercaptothiadiazole, to form a fixed conversion coating, also indicated by numeral 44, on the surface 42 of the article 40. (That the corrosion-inhibiting compound is free of hexavalent chromium means that it is also necessarily free of chromate $CrO_4^{-2}$ ions.) Examples of operable hexavalent-chromium-free, corrosion-inhibiting compounds include the ammonium salt of 1-pyrrolidinedithiocarbamate (CAS number 5108-96-3, Beilstein number 3730472), the dipotassium salt of 2,5 dimercapto 1,3,4 thiadiazole (CAS number 4628-94-8, Beilstein number 4917786), the sodium salt of diethyl dithiocarbamate (CAS number 207233-95-2, Beilstein number 3569024), and the sodium salt of dimethyl dithiocarbamate (CAS number 20624-25-3, Beilstein number 3920507). The preferred salt of the dithiocarbamate or salt of the dimercaptothiadiazole is preferably in aqueous solution when contacted to the surface 42 of the article 40, as schematically indicated in FIG. 2D.

The reaction between the polyaniline salt, preferably emeraldine salt, and the dithiocarbamate in step 28 produces a fixed conversion coating 44 that includes a reduced polyaniline and a fixed sulfur-linked, water-insoluble dithiocarbamate polymer or dimer, adherently bonded to the surface 42, as illustrated in FIG. 2E. The dithiocarbamate is fixed in the conversion coating 44 as an insoluble disulfide-linked dithiocarbamate polymer or dimer of the dithiocarbamate on the surface 42 and within the conversion coating 44.

Figure 3:
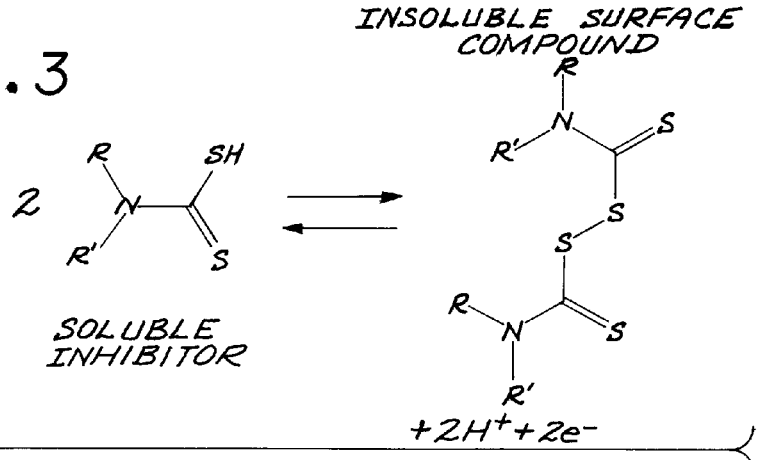
FIG. 3 is a schematic diagram of the reversible electrochemical dimerization reaction of dialkyldithiocarbamate.
Figure 4:
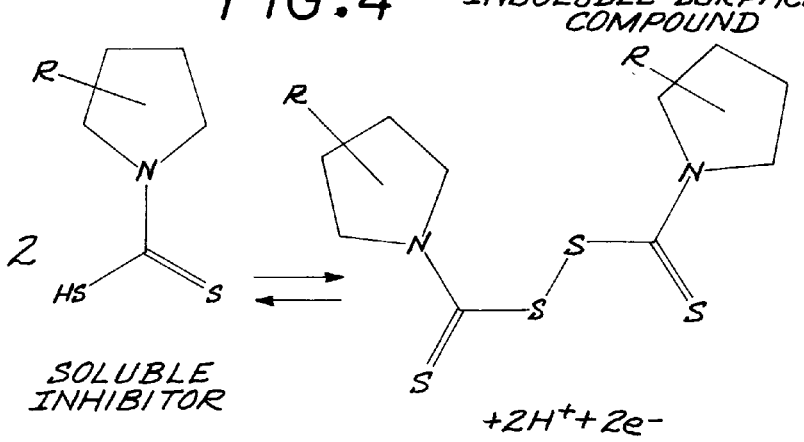
FIG. 4 is a schematic diagram of the reversible electrochemical dimerization reaction of 1-pyrrolidinedithiocarbamate.
Figure 5:
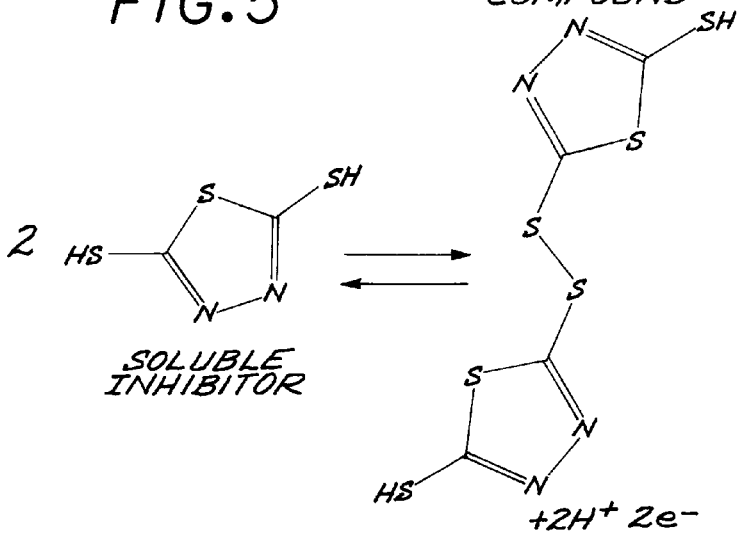
FIG. 5 is a schematic diagram of the reversible electrochemical dimerization reaction of 2,5 dimercaptothiadiazole.
Figure 6:
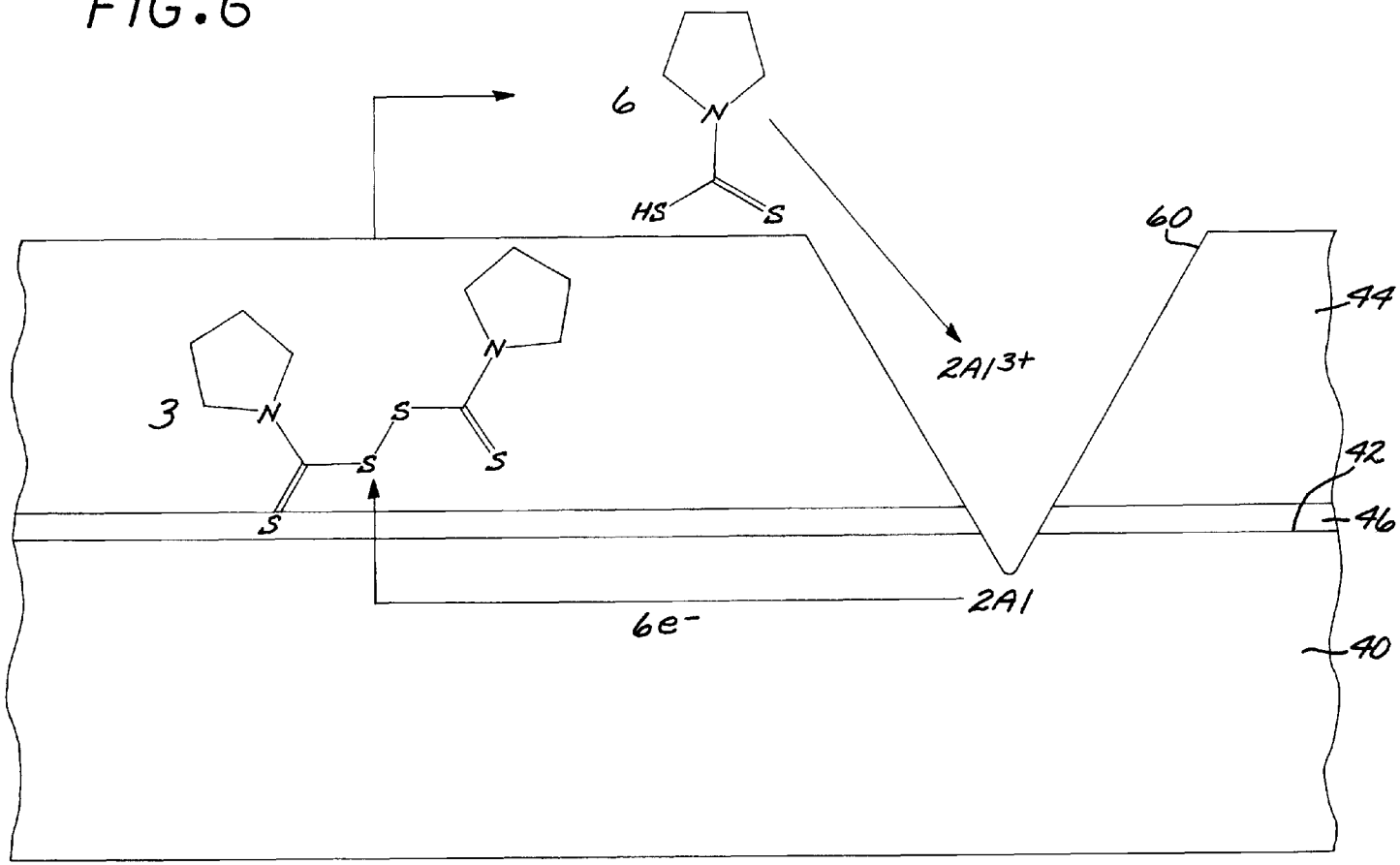
FIG. 6 is a schematic elevational drawing illustrating the protection mechanism of the present approach.

The fixed conversion coating comprises a mixture of a chemically reduced polyaniline salt and a fixed disulfur-linked dithiocarbamate polymer or dimer such as produced by reversible electrochemical reactions depicted in FIGS. 3-5. These reactions depict the oxidations of di-alkyldithiocarbamates (FIG. 3), 1-pyrrolidine carbothioic acid (FIG. 4), and dimercaptothiadiazole (FIG. 5). In each case, the reactant is electrochemically convertible between a water soluble form that acts as an oxygen-reduction reaction (ORR) inhibitor while the products are in solution (the left side of the reaction in each of FIGS. 3-5) and an insoluble form that is mixed into the adherent conversion coating 44 (the right side of the reaction in each of FIGS. 3-5). The thiadiazole forms an insoluble polymer while the other compounds form insoluble dimers. In this way the adherent conversion coating 44 stores the inhibitor in an insoluble form until its release in the soluble, ORR-inhibitor form is required by the corrosive conditions of the environment and the condition of the coating.

The protected article 40 with the fixed conversion coating 44 thereon is thereafter typically exposed to a corrosive environment, an example being a salt-containing environment such as an aqueous salt spray, step 30. The conversion coating 44 and the underlying metal oxide layer 46 provide barrier-type corrosion protection over the broad expanse of the surface 42. However, the barrier-type protection provided by the conversion coating 44 and the metal oxide layer 46 may be damaged and thence breached, as for example by a scratch 60 that penetrates the conversion coating 44 and the metal oxide layer 46 to the metal of the article 40, see FIG. 6. The barrier-protection mechanism is no longer effective in this area. The present approach provides corrosion protection in the damaged area by the following mechanism. Metal atoms of the article 40 ($Al^{3+}$ ions in FIG. 6) dissolve at the location of the breach, producing electrons that migrate through the metal into the conversion coating 44. The electrons react with the polymerized or dimerized and insoluble disulfide-linked dithiocarbamate or dimercaptothiadiazole polymer or dimer (in the preferred embodiment), forcing the reactions depicted in FIGS. 3-5 to the left. The insoluble disulfide-linked dithiocarbamate polymer or dimer depolymerize and is released into solution to produce soluble dithiocarbamate or dimercaptothiadiazole monomers according to the reversible electrochemical reaction. The dithiocarbamate monomers serve as water-soluble inhibitors to the oxidation reduction reaction that is associated with a corrosive attack on the surface 42 of the metallic article 40, thereby inhibiting further corrosive attack at the site of the breach. This corrosion protection is released only as and when needed, and at the site where needed, in the illustrated case in the vicinity of the scratch 60.

One important feature of the present approach is that the article and its coatings need not be intentionally heated above about room temperature (i.e., about 25° C.) during the coating and protective processing described herein, during or after the step of applying and prior to exposure to a corrosive atmosphere. That is, heating is not required for the success of the processing approach. Unintentional heating to temperatures above room temperature, for example as a result of an increase in the ambient temperature on a warm day or the article being heated by the sun, is acceptable. The fixed conversion coating is stable at slightly elevated temperatures, such as up to about 100° C., so that the protected article may be stored or used at such slightly elevated temperatures in service, without degradation of the fixed conversion coating.

The present approach has been reduced to practice using the preferred embodiment of the approach illustrated in FIG. 1. A piece of the aluminum alloy Al 2024-T3 was used as the article 40. The reactive solution was an aqueous mixture of 80:20 (by volume) formic acid:di-chloroacetic acid solution, with emeraldine as described previously. The adherent conversion coating of this reactive solution was applied by spray coating to the surface of the piece of aluminum alloy and allowed to dry. The dried adherent conversion coating was exposed to air at room temperature for 2 hours to oxidize it. The oxidized coating was contacted with a 0.5 molar aqueous solution of 1-pyrrolidinedithiocarbamate at room temperature for 24 hours to form the fixed conversion coating, completing the preparation of the protected metal article.

The completed protected metal article was tested for resistance to salt fog corrosion according to the ASTM B117 standard test for 168 hours. The unsealed polyaniline-coated AA2024-T3 specimen was completely covered by a white corrosion product after 72 hours of exposure. This is the same appearance that a blank panel has after 24 hours of exposure. The panel sealed with the fixed 1-pyrrolidinedithiocarbamate conversion coating showed virtually no corrosion after 168 hours of exposure.

Figure 7:
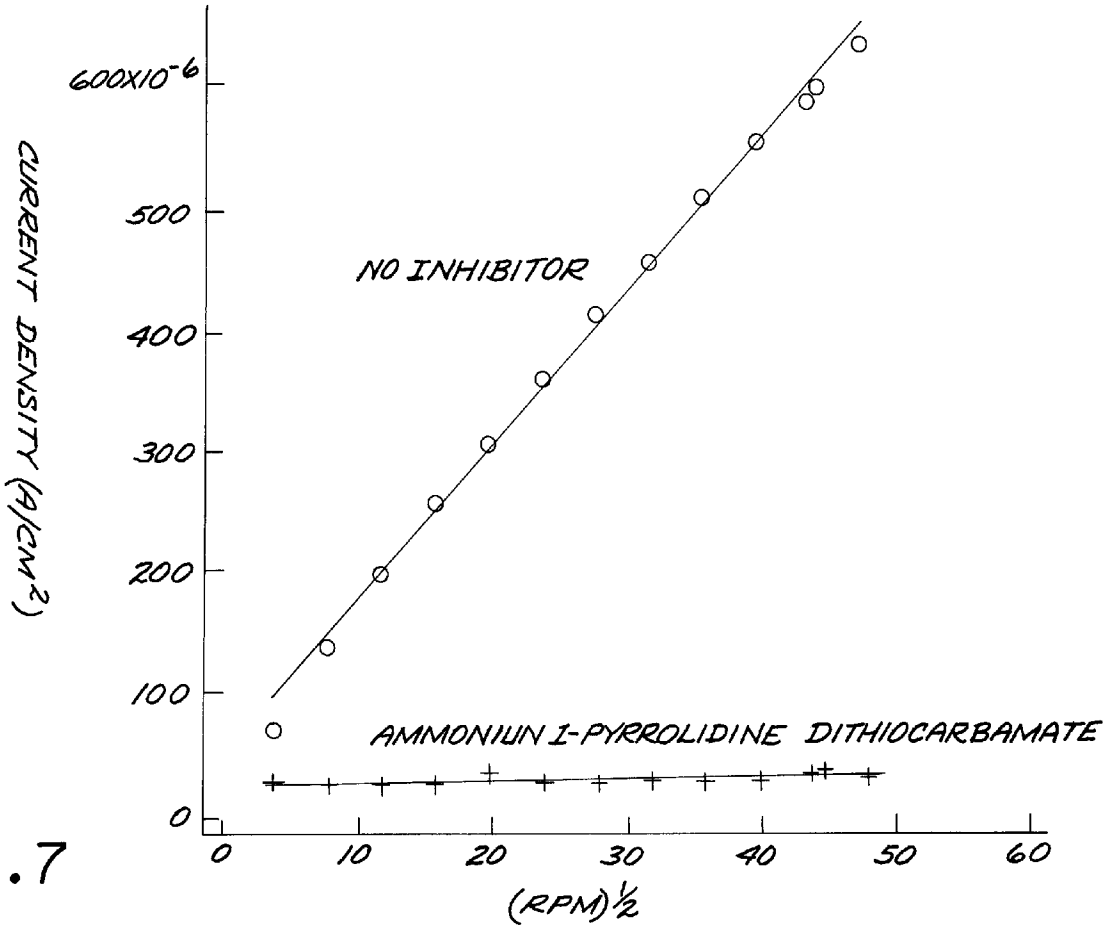
FIG. 7 is a graph illustrating the effectiveness of the reduced fixed inhibitor in inhibiting the oxygen reduction reaction at a well-defined cathode.

FIG. 7 is a graph showing the results of a rotating disk evaluation of the effectiveness of the ammonium salt of 1-pyrrolidinedithiocarbamate to inhibit the ORR. FIG. 7 presents a plot of the ORR current at a rotating disk cathode biased to −0.7 volts vs. reference as a function of the rotation rate. The copper cathode serves as a model for the catalytic intermetallic phases in the alloy. At a high rotation rate, a high current flows if the ORR is not obstructed. In the presence of the inhibitor to the ORR, virtually no current flows at any rotation rate.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for protecting a surface of a metallic article, comprising the steps of preparing a reactive solution of an oxidized form of an electrically conducting polymer and an acid, wherein the acid comprises a mixture of formic acid and di-chloroacetic acid in a ratio of 80 parts by volume formic acid and 20 parts by volume di-chloroacetic acid; thereafter applying the reactive solution to the surface of the article, the reactive solution reacting with the surface of the article to form an adherent conversion coating comprising a reduced polyaniline salt and an oxide on the surface; thereafter oxidizing the adherent conversion coating to form an oxidized coating; and thereafter contacting a non-chromate, reversibly oxidizable inhibitor and the oxidized coating to cause a fixing reaction that forms a fixed conversion coating on the surface of the article such that the fixed conversion coating, when damaged, releases a chromate-free inhibitor by a reversal of the fixing reaction.

2. The method of claim 1, wherein the step of preparing includes the step of preparing the reactive solution comprising a form of a polyaniline as the electrically conducting polymer.

3. The method of claim 1, wherein the step of preparing includes the step of preparing the reactive solution comprising emeraldine base as the electrically conducting polymer.

4. The method of claim 1, wherein the step of applying includes the step of applying the reactive solution by spray, brush or spin application.

5. The method of claim 1, wherein the step of oxidizing includes the step of oxidizing the adherent conversion coating in air.

6. The method of claim 1, wherein the step of contacting includes the step of contacting a salt of a dithiocarbamate or a salt of a dimercaptothiadiazole to the oxidized coating.

7. The method of claim 1, wherein the step of contacting includes the step of contacting 1-pyrrolidinedithiocarbamate to the oxidized coating.

8. The method of claim 1, wherein the step of applying includes the step of furnishing the article made of aluminum.

9. The method of claim 1, including an additional step, after the step of contacting, of exposing the article with the fixed conversion coating thereon to a corrosive environment.

10. The method of claim 1, including an additional step, after the step of contacting, of exposing the article with the fixed conversion coating thereon to a corrosive environment, and wherein the article is not intentionally heated to a temperature of greater than about 25° C. during or after the step of applying and before the step of exposing.

11. The method of claim 1, wherein the hexavalent chromium-free inhibitor is a dithiocarbamate or a dimercaptothiadiazole oxygen-reduction inhibitor.

12. A method for protecting a surface of an article, comprising the steps of preparing a reactive solution of an emeraldine base form of polyaniline and an acid, wherein the acid comprises a mixture of formic acid and di-chloroacetic acid in a ratio of 80 parts by volume formic acid and 20 parts by volume di-chloroacetic acid; thereafter applying the reactive solution to the surface of the article comprising aluminum, the reactive solution reacting with the surface of the article to form an adherent conversion coating comprising a reduced polyaniline salt and an oxide on the surface; thereafter oxidizing the adherent conversion coating to form an oxidized coating by exposing the adherent conversion coating to air; and thereafter contacting a salt of a dithiocarbamate or a salt of a dimercaptothiadiazole to the oxidized coating to form a fixed conversion coating on the surface of the article that, when damaged, releases a chromate-free inhibitor by a reversal of the fixing reaction.

13. The method of claim 12, wherein the step of applying includes the step of applying the reactive solution by spray, brush or spin application.

14. The method of claim 12, including an additional step, after the step of contacting, of exposing the article with the fixed conversion coating thereon to a corrosive environment.

15. The method of claim 12, including an additional step, after the step of contacting, of exposing the article with the fixed conversion coating thereon to a corrosive environment, and wherein the article is not intentionally heated to a temperature of greater than about 25° C. during or after the step of applying and before the step of exposing.

* * * * *